US006135714A

United States Patent [19]

Hsu

[11] Patent Number: 6,135,714

[45] Date of Patent: Oct. 24, 2000

[54] NECKLACE HANGER FOR PORTABLE FAN

[76] Inventor: Chin-Tien Hsu, No 3, Alley 15, Lane 54, Fu-Te 2nd Rd., His-Chih Chen, Taipei Hsien, Taiwan

[21] Appl. No.: 09/258,937

[22] Filed: Mar. 1, 1999

[51] Int. Cl.[7] ..... F04D 29/64

[52] U.S. Cl. ..... 416/63; 416/146 R; 416/244 R; 416/247 R

[58] Field of Search ..... 415/121.3; 416/63, 416/146 R, 247 R, 244 R

[56] References Cited

U.S. PATENT DOCUMENTS 5,146,765 9/1992 Waters ..... 62/259.3
5,304,035 4/1994 Carter ..... 416/63

*Primary Examiner*—Edward K. Look
*Assistant Examiner*—Richard Woo
*Attorney, Agent, or Firm*—Raymond Y. Chan; David and Raymond

[57] ABSTRACT

A necklace hanger for mounting on a portable fan to be worn is disclosed. The hanger includes a main body having a ring for fitly mounting on a fan and an extension for supporting the shroud of the fan. Then a cord is connected to the extension to form a loop for hanging the fan to one's neck. The hanger can selectively combine with the fan by user and is suitable for applying to other portable fans. Furthermore, the connecting mechanism of the cord and the main body is in a detachable manner that when an outer force applied to the connectors exceeds a certain extent, the cord will be released from the hanger to prevent from harms of a wearer.

7 Claims, 5 Drawing Sheets

NECKLACE HANGER FOR PORTABLE FAN

BACKGROUND OF THE INVENTION

The present invention relates to a portable fan and, more particularly, to a necklace hanger for portable fan, which is suitable for applying to any kind of portable fans so that a cord can be fixed therewith for hanging the fan to wearer's neck.

U.S. Pat. No. 5,304,035 discloses a portable necklace fan, as shown in FIG. 1, which comprises a motor housing and motor-driven fan enclosed in a shroud 10. A cord 12 is attached to the shroud 10 and forms a loop for hanging the fan the to wearer's neck and blowing air upward to the wearer's face. The two ends of the cord 12 are of affixed to the shroud 10 by passing through two connecting parts 11 provided on the shroud and being tied into knots. The portable fan becomes popular because of its convenience, especially for outdoor usage. But there are still some disadvantages as follows:

(1) During the production, the connecting part 11 has to be formed on the shroud 10, and the cord 12 has to be tied thereon manually.

(2) The connecting part 11 is fixedly formed on the shroud 10. It is impossible to merely combine the connecting part 11 with fans for wearing.

(3) The fixed cord 12 of the fan comes with danger when hanging to a child's neck. Children playing with the fan may seize the cord from the back of the wearer and possibly cause injury or even death to the wearer.

SUMMARY OF THE INVENTION

Accordingly, an object of the present invention is to provide a hanger for portable fan, which is capable of mounting with any kind of fans to facilitate the use.

The hanger according to the present invention includes a main body having a ring for fitly mounting on a fan and an extension for supporting a shroud of the fan. Then a cord can connect to the extension to form a loop for hanging the fan to a user's neck. The hanger can selectively combine with the fan by user and is suitable for applying to other portable fans.

Another object of the present invention is to provide a hanger for portable fan capable of hanging to one's neck and preventing from squeeze injury to the wearer.

A hanger according to the present invention includes a cord attachable to an extension thereof for the purpose of hanging a portable fan. A connecting mechanism of the cord and a main body of the hanger are in a detachable manner that when an outer force applied to the cord exceeds a certain extent, the cord will be released from the main body to prevent harms to a wearer. An embodiment of the present invention includes two through holes formed on suitable positions on the extension of the hanger for linking the cord. Lockers are formed at two ends of the cord respectively which can be released from the holes when forcibly pulled apart.

The objectives and advantages of the present invention will become apparent from a detailed description provided below, with reference to the accompanying drawings.

DETAILED DESCRIPTION OF PREFERRED EMBODIMENTS

Figure 1:
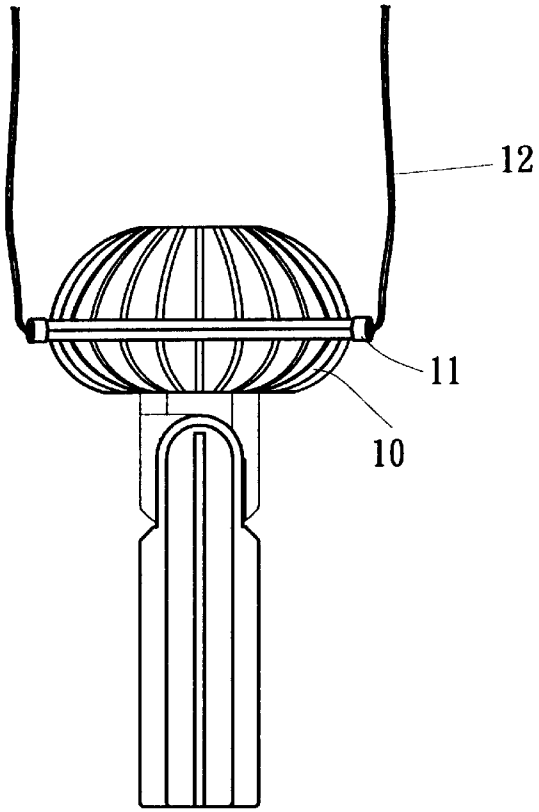
FIG. 1 (PRIOR ART)
FIG. 1 is a plane view of a prior portable fan.
Figure 2B:
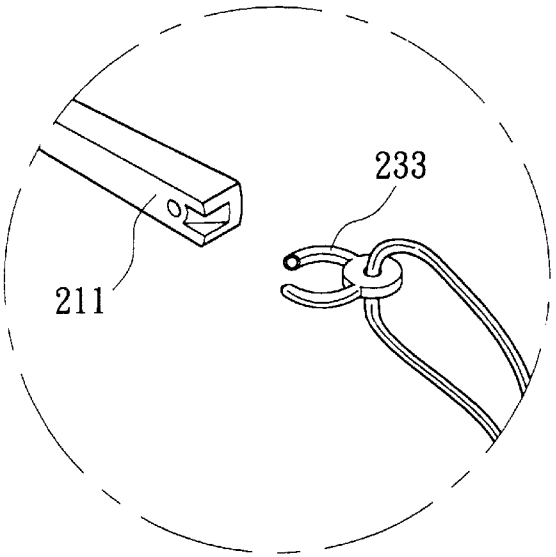
FIG. 2B is an enlarged partial perspective view of the locker and the extension of the main body according to the above preferred embodiment of the present invention.
Figure 2A:
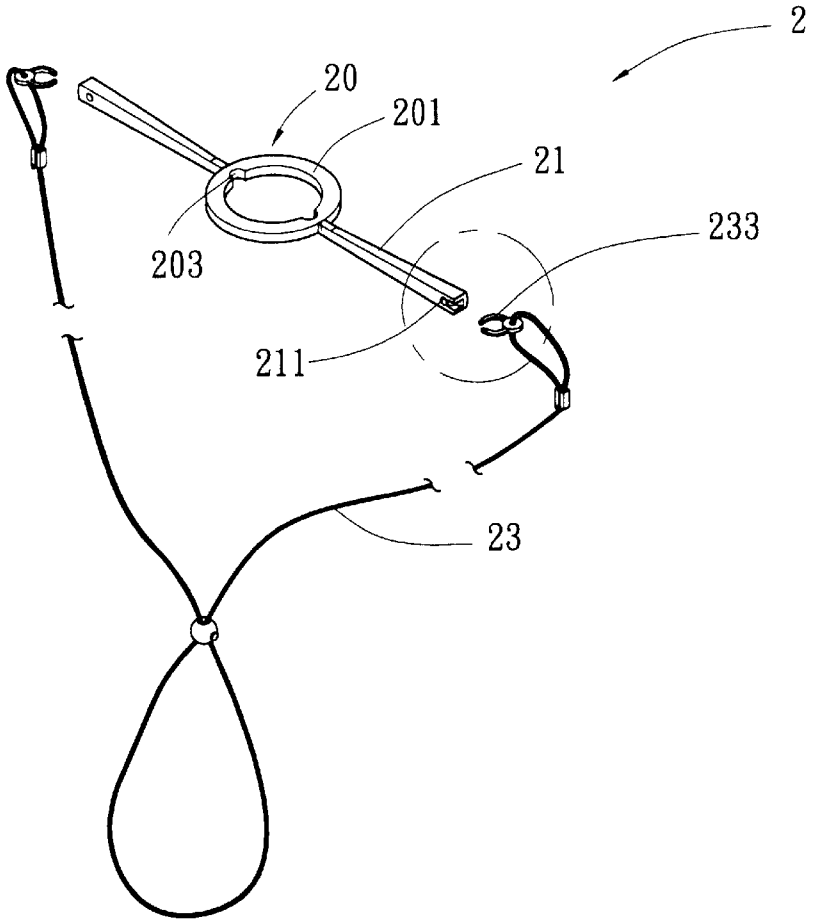
FIG. 2A is a perspective view of a hanger of a preferred embodiment of the present invention.

Referring to FIGS. 2 to 5 a hanger for a portable fan according to an embodiment of the present invention is shown.

The hanger 2 includes a main body 20 which has a ring 201 and an extension 21 for mounting between a housing 3 (shown in FIG. 3) and a shroud 10 of the fan. A cord 23 is connected to the extension 21 of the main body 20.

Figure 3:
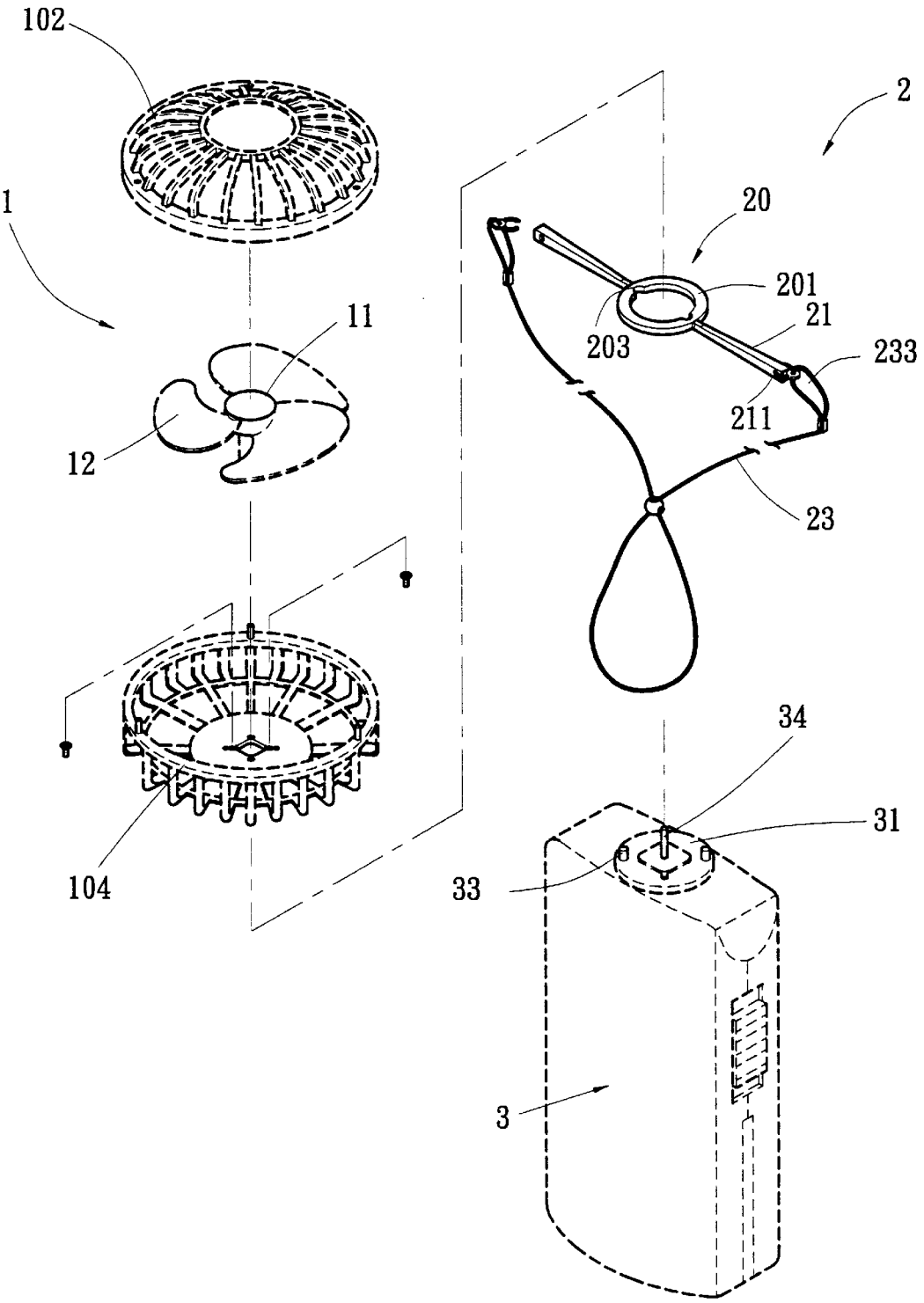
FIG. 3 is an exploded view of the hanger of FIG. 2 for a portable fan.
Figure 4:
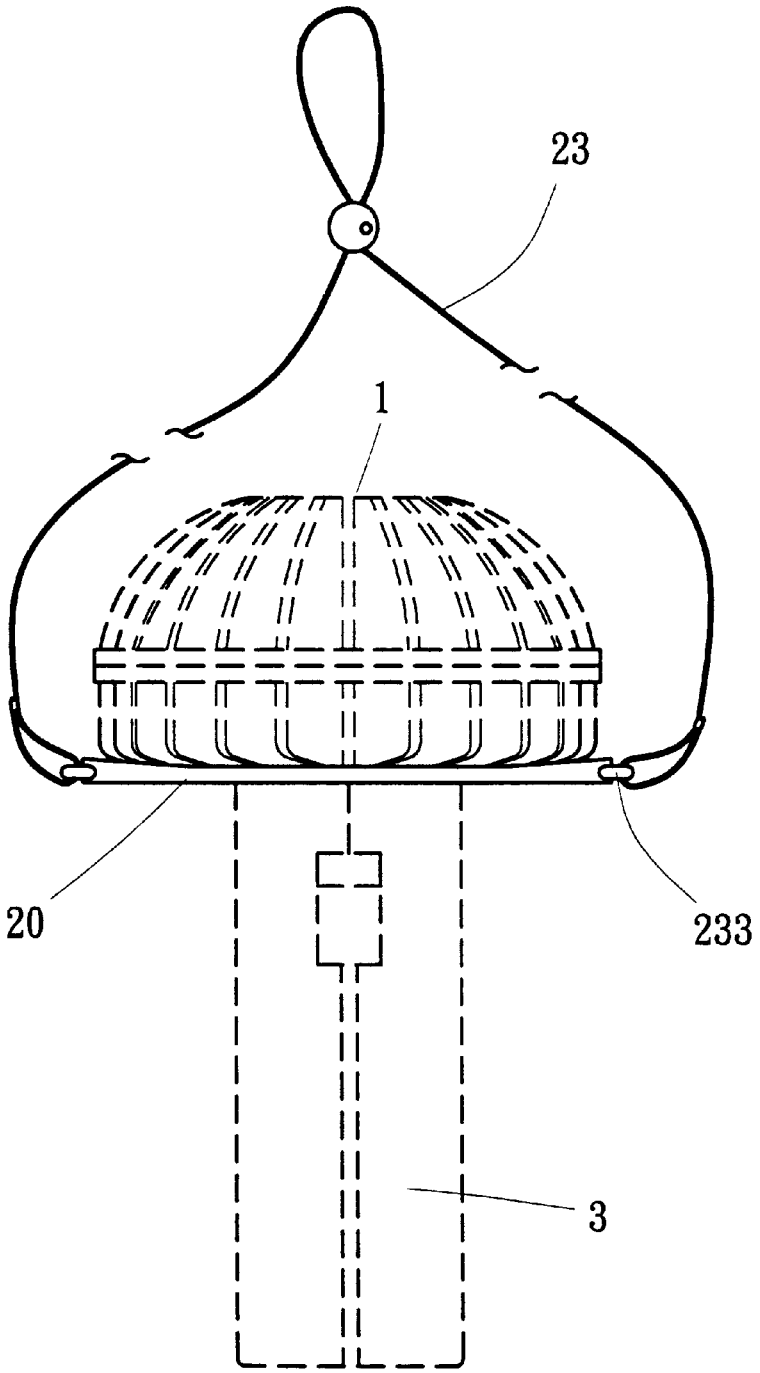
FIG. 4 is a plane view of combination of the hanger and the fan of FIG. 3.

Referring to FIG. 3, the portable fan includes a housing 3 containing electric motor (not shown) and a blower 1 consisting of the shroud 10, a hub 11 and a plurality of vanes 12 projecting radially outwardly from the hub 11. The upper frame 102 and the lower frame 104 connected at locations around the circumference of the shroud 10 enclose the vanes 12 and the hub 11 which is mounted on the shaft 34 connected to the motor. The motor rotates the shaft 34 which turns the hub 11 and vanes 12 creating a current of air. In this embodiment, the main body 20 of the hanger 2 can be fitly mounted on a top surface 31 of the housing 3. The ring 201 of the main body 20 includes two semi-circular recesses 203 to match the corresponding protrusions 33 formed on the top surface 31 for combining the main body 20 with the housing 3. Then the shroud 10 is mounted above the hanger 2 by screwing the lower frame 104 on the housing 3. The hanger 2 is of affixed between the blower 1 and the housing 3 as shown in FIG. 4. Alternatively, the hanger 2 can be separated from the fan where the shroud 10 is directly mounted on the housing 3. Therefore, the hanger 2 of the invention is suitable for applying to any kind of portable fans.

Figure 5:
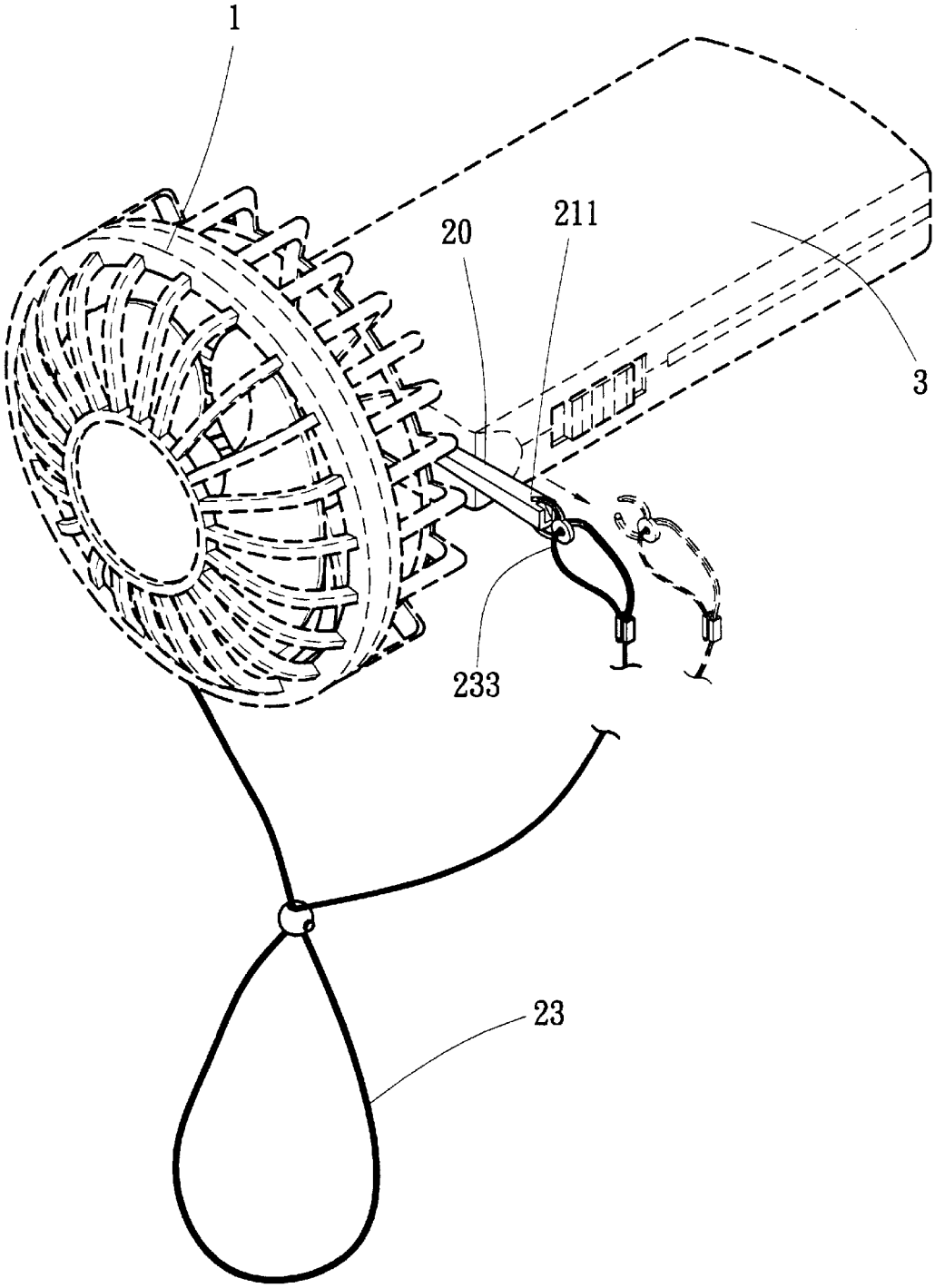
FIG. 5 is a perspective view showing the cord connecting to and releasing from the extension of the hanger mounted on the fan.

Referring again to FIGS. 2A and 2B, the cord 23 is connected to the extension 21 to form a loop for hanging the fan to the wearer. The simplest way for the connection is to attach the cord 23 on the extension 21. However, it is not safe for use. In order to avoid the possible danger of wearing the fan and grasped by others (especially when it is used by a child, the cord may be played by others that causes injury to the child's neck), two connecting ends of the extension 21 and two ends of the cord 23 are connected in a detachable manner in the present invention. In this embodiment, a through hole 211 is formed on each of the connecting ends and a locker 233 such as C-shaped clip is furnished at each end of he cord 23. The main body 20 and the lockers 233 are preferably made of plastic materials. There are nodes formed at each tip of the clip 233 for engaging on open ends of the through hole 211. The diameter of the clip 233 is smaller than that of the length of the through hole 211, so as to hold the respective connection end of the extension 21 in an usual load condition, but releases the will be released extension 21 when additional pulling force applies on it to force the C-shaped clip 233 expends its opening due to the flexibility of the material. The detachment of the locker 233 from the extension 21 , as shown in FIG. 5, will ensure the safety of the wearer.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A hanger for a portable fan, mounted between a housing and a shroud of the fan adapted to be worn on a wearer, comprising:

a main body having a ring for fitly mounting on the housing and an extension for supporting the shroud of the fan; and a cord connected to the extension to form a loop for hanging the fan to the wearer.

2. The hanger for a portable fan according to claim 1 wherein the ring of the main body includes a plurality of semi-circular recesses to match corresponding protrusions formed on a top surface of the housing.

3. The hanger for a portable fan according to claim 1 wherein two lockers are provided at two ends of the cord which is detachable from the extension of the main body by forcibly pulling the locker apart from the extension of the main body.

4. The hanger for a portable fan according to claim 3 wherein two through holes are formed on the two ends of the extension of the main body for linking the lockers furnished on the two end of the cord respectively.

5. A hanger for a portable fan, mounted between a housing and a shroud of the fan adapted to be worn on a wearer, comprising a main body having a ring for fitly mounting on the housing of the fan;

an extension extended from the main body for supporting the shroud of the fan; and a cord having two ends each furnished with a locker for engaging with the extension for hanging the fan to the wearer;

whereby the engagement between the lockers and the extension is detachable when the cord is forcibly pulled apart from the extensions in order to prevent injury to the wearer.

6. The hanger for a portable fan according to claim 5 wherein the ring of the main body includes a plurality of semi-circular recesses to match corresponding protrusions formed on a top surface of the housing.

7. The hanger for a portable fan according to claim 5 wherein two through holes are formed on two ends of the extension, and each of the lockers comprises a C-shaped clip having a node formed at a tip thereof for engaging on the respective through hole.

* * * * *